United States Patent [19]

Iwata

[11] Patent Number: 4,691,807

[45] Date of Patent: Sep. 8, 1987

[54] ELEVATOR CONTROL APPARATUS

[75] Inventor: Shigemi Iwata, Aichi, Japan

[73] Assignee: Mitsubishi Denki Kabushiki Kaisha, Japan

[21] Appl. No.: 836,522

[22] Filed: Mar. 5, 1986

[51] Int. Cl.[4] ..... B66B 5/08

[52] U.S. Cl. ..... 187/117

[58] Field of Search ..... 187/29, 117

[56] References Cited

U.S. PATENT DOCUMENTS

| | | | |
|---|---|---|---|
| 4,225,015 | 9/1980 | Yamada | 187/29 R |
| 4,456,096 | 6/1984 | Kajiyama | 187/29 R |
| 4,503,939 | 3/1985 | Lawrence et al. | 187/29 R |

FOREIGN PATENT DOCUMENTS 58-135075 8/1983 Japan .

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

An elevator control apparatus for controlling operation of a cage in an elevator system in which a normal speed command signal is generated having a normal pattern providing gradually decreasing terminal speed as the cage approaches a level of a terminal floor; a terminal-floor slowdown signal is generated having a normal pattern generally similar to the normal pattern of the normal speed command signal and separated therefrom by a magnitude determined by a bias value; the normal speed command signal is chosen as a final terminal slowdown command signal for controlling terminal speed of the cage when, based on comparing the command signals, the normal speed command signal is less than the terminal-floor slowdown command signal, or the terminal-floor slowdown command signal is chosen as the final terminal slowdown command signal for controlling terminal speed of the cage when, based on comparing the command signals, the normal speed command signal is not less than the terminal-floor slowdown command signal; and the terminal-floor slowdown command signal is corrected when chosen as the final terminal slowdown command signal by changing the bias value used in generating the final terminal-floor slowdown command signal; whereby the final terminal slowdown command signal follows at least a final portion of the normal pattern of the normal speed command signal.

7 Claims, 8 Drawing Figures

ELEVATOR CONTROL APPARATUS

BACKGROUND OF THE INVENTION

This invention relates to a control apparatus for elevators, and more particularly to an elevator control apparatus which generates a terminal floor deceleration command signal.

A prior art elevator control apparatus will be described with reference to FIGS. 1-4.

FIG. 1 shows a diagram of the overall elevator control apparatus, and concerns the prior-art apparatus and the apparatus of the present invention. Numeral 1 designates a cage, and numeral 2 a counterweight. A rope 3 is wound round a sheave 4, and the cage 1 and the counterweight 2 are respectively suspended from one end and the other end of the rope 3. Numeral 5 indicates an induction motor which drives the sheave 4, numeral 6 a pulse generator which generates pulses proportional to the movement distance of the cage 1 on the basis of the rotation of the motor 5, numeral 7 a counter circuit which counts the pulses from the pulse generator 6, and numeral 8 a microcomputer system which receives the pulse count value 7*a* of the counter circuit 7 to calculate a residual distance by way of example. Shown at numeral 9 is a three-phase A.C. power source. Numeral 10 indicates a power conversion device which converts three-phase alternating current into electric power suitable for the speed control of the elevator, and to which a command signal 8*a* from the microcomputer system 8 is applied thereby to control the torque and rotational frequency of the motor 5. Numeral 11 denotes the plane of a terminal floor, and numeral 12 a cam mounted on the cage 1. A terminal position detector 13 is disposed in a hoistway, and an output signal 13*a* delivered therefrom is input to the microcomputer system 8.

FIG. 2 shows the details of the microcomputer system 8. This microcomputer system comprises first and second microcomputers 80 and 90. The first microcomputer 80 includes a CPU 81, a ROM 83, a RAM 84, an input port 85, and an output port 86 which the connected to each other through a bus 82. The input port 85 is supplied with the pulse count value 7*a* of the counter circuit 7. The microcomputer 80 thus arranged performs the running control and sequence control of the cage 1, and generates a normal speed command signal $V_N$ being the ordinary speed command signal of the cage 1. The normal speed command signal $V_N$ has a relation of $V_N=\sqrt{2\beta_A R_A}$ at a constant deceleration $\beta_A$ in correspondence with a residual distance $R_A$ to a scheduled arrival floor. In addition, the residual distance $R_A$ is calculated on the basis of the pulse count value 7*a* of the counter circuit 7.

Similar to the first microcomputer 80, the second microcomputer 90 includes a CPU 91, a ROM 93, a RAM 94, an input port 95, and an output port 96, all connected to each other through a bus 92. The input port 95 is supplied with the pulse count value 7*a* of the counter circuit 7 and the output signal 13*a* of the terminal position detector 13. The second microcomputer 90 thus arranged generates a command signal 8*a* for controlling the rotational frequency and torque of the motor 5 This command signal 8*a* is delivered from the output port 96 to the power conversion device 10.

When, when the cage 1 has approached the terminal floor, the second microcomputer 90 receives the output signal 13*a* of the terminal position detector 13 and sets a residual distance $R_B$. Thenceforth, it calculates the residual distance $R_B$ on the basis of the pulse count value 7*a* of the counter circuit 7. On the basis of this residual distance $R_B$, a terminal-floor slowdown command signal $V_S$ is calculated in accordance with $V_S=\sqrt{2\beta_B R_B}$. $\beta_B$ is a constant deceleration in accordance with the residual distance $R_B$ and is greater than $\beta_A$.

The normal speed command signal $V_N$ calculated by the first microcomputer 80 is fed into the CPU 91 of the second microcomputer 90 through a transmission interface 100 which connects the respective CPU's 81 and 91 of the first and second microcomputers. The command signal $V_N$ and the terminal-floor slowdown signal $V_S$ are compared in the CPU 91, and the smaller one is used as the final speed command signal. On the basis of this speed command signal, the command signal 8*a* for the power conversion device 10 is delivered through the output port 96.

Owing to the control apparatus for such a construction, even when the normal speed command signal $V_N$ has not lowered due to any abnormality in spite of the approach of the cage 1 to the terminal floor 11, the cage 1 can be safely decelerated by the terminal-floor slowdown command signal $V_S$ so as to arrive at the terminal floor.

FIG. 3 is a diagram in which the relationship between the normal speed command signal $V_N$ calculated by the first microcompuer 80 and the terminal-floor slowdown command signal $V_S$ calculated by the second microcomputer 90 is expressed in correspondence with the residual distances $R_A$ and $R_B$. As seen in FIG. 3, $V_N$ decreases at the constant deceleration $\beta_A$, and $V_S$ decreases at the constant deceleration $\beta_B$. In addition, $V_N$ and $V_S$ become very close for small values of the residual distances.

In this regard, the microcomputers 80 and 90 usually have unequal calculation cycles, and the installation error of the terminal position detector 13 and the response delay thereof are involved, so that the residual distances $R_A$ and $R_B$ become $R_A \neq R_B$.

Near the level of the terminal floor, accordingly, $N_N > V_S$ can occur as shown in FIG. 4 on account of the difference of the calculating cycles, etc., and the terminal-floor showdown command signal $V_S$ is selected in spite of the normal speed command signal $V_N$ being correct. This has led to the problems that comfort in ride becomes worse near the levels of the terminal floors than at intermediate floors, and that the accuracies of floor arrival worsen.

SUMMARY OF THE INVENTION

This invention has the objective of overcoming the problems of the prior art mentioned above, and has for its object to provide a control apparatus for an elevator in which, when a normal speed command signal is correctly decreasing, a terminal-floor slowdown command signal is prevented from being erroneously selected, thereby to prevent the worsening of comfortable ride and floor arrival accuracies in the case of running to terminal floors.

DESCRIPTION OF THE PREFERRED EMBODIMENT

Now, an embodiment of this invention will be described with reference to the drawings.

Figure 1:
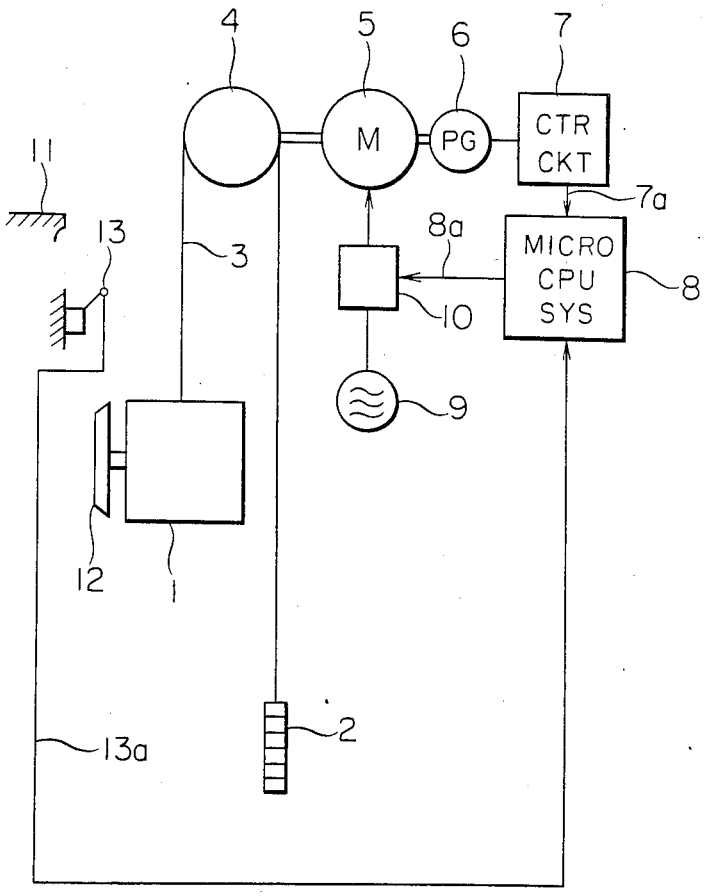
FIG. 1 is a general arrangement diagram of elevator control apparatuses according to the prior art and according to this invention.

The general construction of the elevator control apparatus according to this invention is similar to the construction shown in FIG. 1. The block arrangement of the microcomputer system 8 for generating the terminal-floor slowdown command signal is also similar to the arrangement shown in FIG. 2, but the point of difference of the invention from the prior art explained with reference to FIG. 2 resides in the processing function of the second microcomputer 90 by which the selection of the terminal-floor slowdown command signal is avoided when the normal speed command signal is correctly decreasing. Accordingly, the embodiment of this invention shall be described by utilizing the symbols of the various portions shown in FIGS. 1 and 2.

Figure 5:
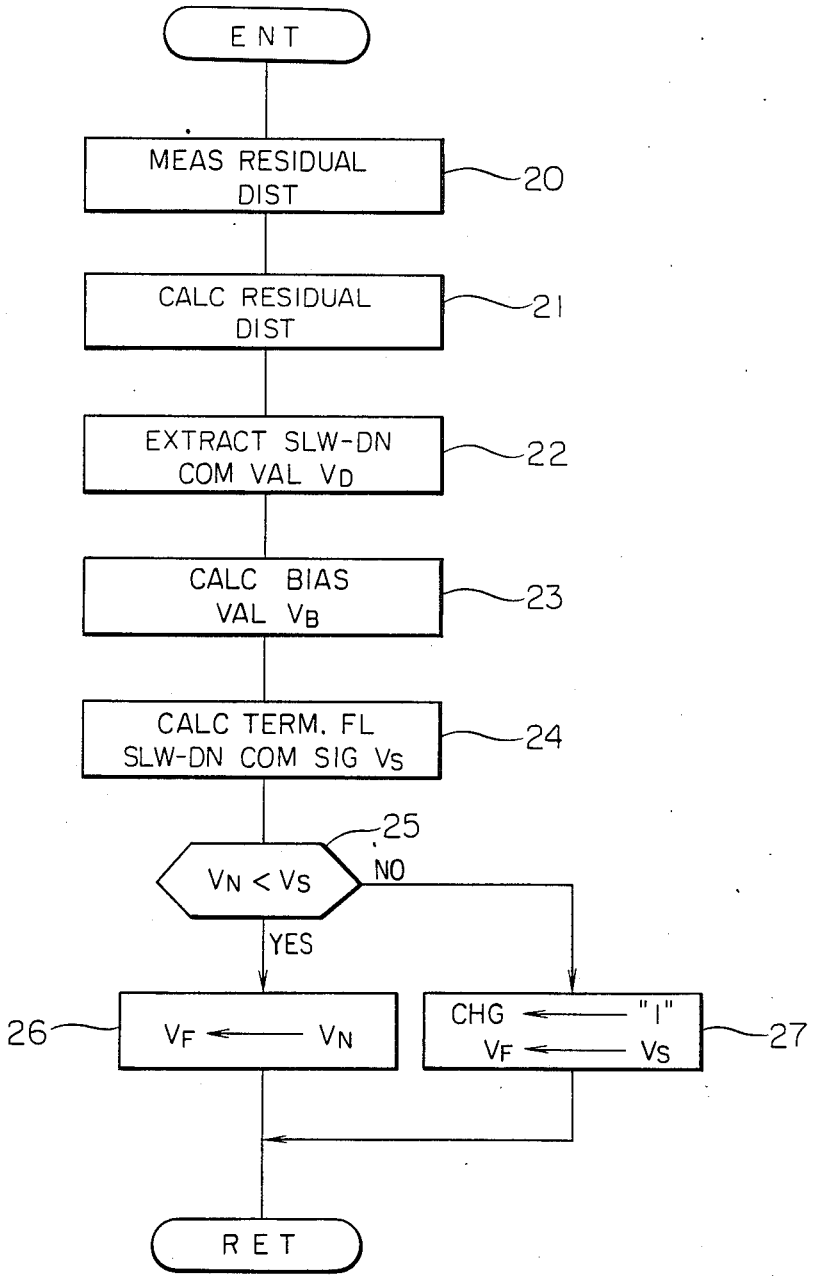
FIG. 5 is a flow chart for generating a terminal-floor speed command, showing an example of the elevator control apparatus according to this invention.
Figure 6:
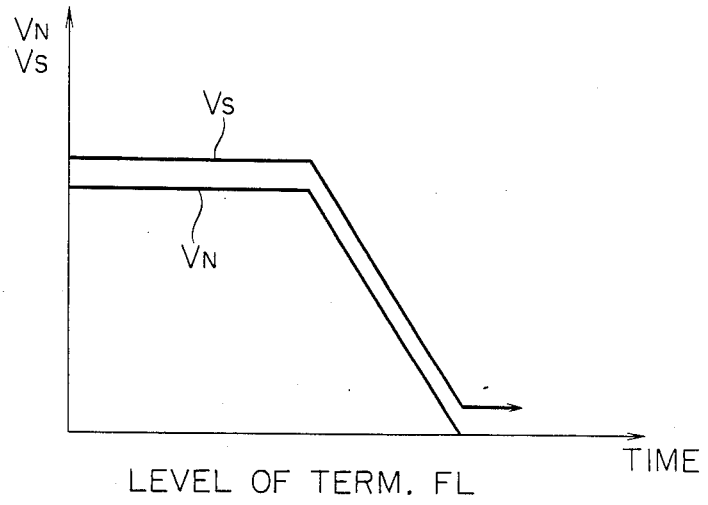
FIGS. 6 and 7 are diagrams for explaining operations in this invention.

FIG. 5 shows a flow chart of a processing routine for generating the terminal-floor slowdown command, furnished with the above processing function of this invention. A program for the process of calculation is stored in the ROM 93 of the second microcomputer 90 within the microcomputer system 8.

Referring to FIG. 5, a processing step 20 serves to set the residual distance. At this step, the output signal 13*a* of the terminal position detector 13 provided when the cage 1 has approached the level of the terminal floor 11 is fed into the CPU 91 through the input port 95, whereby the residual distance to the terminal floor is initialized. At the next processing step 21, the pulse count value 7*a* being the output signal of the counter circuit 7 is subtracted from the residual distance set by the processing step 20, thereby to obtain the residual distance $R_B$ in each calculating cycle of the microcomputer 90.

The next processing step 22 executes a process in which a slowdown command value $V_D$ corresponding to the residual distance $R_B$ calculated by the step 21 is extracted from the ROM 93. Here, the slowdown command values $V_D$ corresponding to the residual distance values $R_B$ to be provided every calculation cycle are stored as $V_D=\sqrt{2\beta_A R_B}$ in the form of a table within the ROM 93.

When the process of the step 22 has ended, the control flow shifts to the next step 23 which executes the calculation of a bias value $V_B$. More specifically, when the relationship between the normal speed command signal $V_N$ and the terminal-floor slowdown command signal $V_S$ has become $V_S \geqq V_S$ near the level of the terminal floor and the speed command signal $V_S$ has been selected, the selected $V_S$ signal is corrected by the processing means under control of the program steps 24 and 27 so that the final speed command signal F is the signal $V_S$ corrected in such a way as to change to the pattern of the normal speed command signal $V_N$ illustrated in FIG. 7, following the intermediate segment b-d until the signal $V_S$ joins at the point d the normal pattern c-d-e of the normal speed command signal $V_N$ and then follows the same final pattern segment d-e as the normal speed command signal $V_N$. By following the pattern c-b-d-e, the corrected final command signal $V_S$ is determined by calculation to follow a pattern which provides a comfortable ride and high floor arrival precision. To this end, in the case where $V_N \geqq V_S$ due to an abnormal operation, the bias value $V_B$ is extracted from the ROM 93 so as to gradually decrease from $V_{BO}$ (constant value) in succession in time correspondence. On the other hand, when $V_N < V_S$ holds, the bias value $V_B$ is maintained at the constant value $V_{BO}$ set in advance.

The bias value $V_B$ to be extracted in time correspondence are stored in the form of a table within the ROM 93.

A step 24 succeeding the step 23 is a routine for calculating the terminal-floor slowdown command signal $V_S$. Here, the process $V_S \leftarrow V_D + V_B$ of adding the slowdown command value $V_D$ extracted at the step 22 and the bias value $V_B$ extracted at the step 23 is executed to obtain the terminal-floor slowdown command signal $V_S$.

Subsequently, the control flow shifts to a step 25, which compares the terminal-floor slowdown command signal $V_S$ and the normal speed command signal $V_N$ to decide whether or not $V_N < V_S$ holds. When $V_N < V_S$ holds, the control flow shifts to a step 26, which executes a process $V_F \leftarrow V_N$ to make the normal speed command signal the final speed command signal $V_F$. More specifically, in the case where $V_N < V_S$ holds, the terminal-floor slowdown command signal $V_S$ ought not to be selected. As $V_N$ is correctly decreasing and follows the normal pattern as shown, the terminal-floor slowdown command signal $V_S$ which is $V_D + V_{BO}$ follows a normal pattern generally similar to the normal pattern of the normal speed command signal $V_N$, as shown in FIG. 5, and is greater than $V_N$ by $V_{BO}$ (the patterns are shown separated by a magnitude determined by the bias value $V_{BO}$) even when the cage 1 has come to the vicinity of the level of the terminal floor 11, so that $V_S$ is not selected erroneously.

Figure 7:
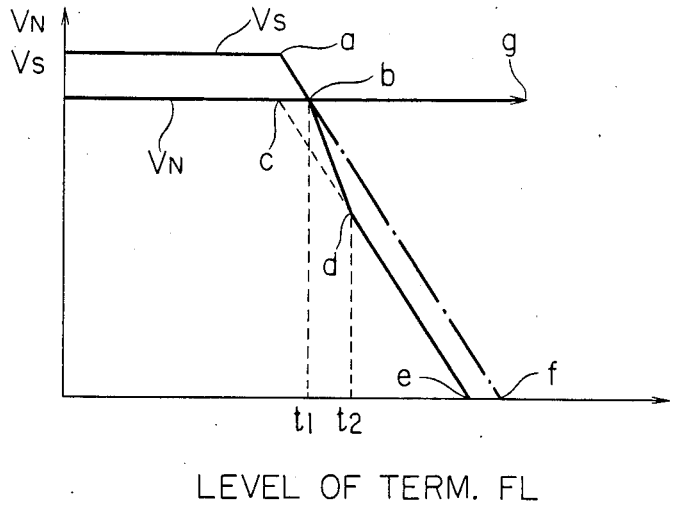

On the other hand, when the step 25 has decided that $V_N < V_S$ does not hold, namely, that $V_N \geqq V_S$ holds as illustrated in FIG. 7, the control flow shifts to a step 27 at which a flag CHG is set to "1" and at which the selected terminal-floor slowdown command signal $V_S$ is corrected so as to become the final speed command signal $V_F$ to provide a comfortable ride and to increase the floor arrival accuracy. More specifically, when the flag CHG has been set to "1", the microcomputer 90 executes at the step 22 the process in which the bias value $V_B$ for the slowdown command value $V_D$ is gradually decreased in succession from a point of time $t_1$ indicated in FIG. 7, thereby the correct the terminal-floor slowdown command speed $V_S$ to follow the pattern segment b-d as indicated by a solid line in FIG. 7. In this way, even when the terminal-floor slowdown command signal $V_S$ has been selected by the microcomputer 90, the comfortable ride near the level of the terminal floor can be maintained and floor arrival precision can be obtained.

Referring again to FIG. 7, when the normal speed command signal $V_N$ normally decreases gradually near the terminal floor, it changes along a normal pattern segment c - d - e, while the terminal-floor slowdown command signal $V_S$ changes along a pattern segment a - b - f. Accordingly, the relationship between $V_N$ and $V_S$ becomes $V_N < V_S$, and Vis selected for the final speed command signal $V_F$.

When the signal $V_N$ does not follow the normal pattern near the terminal floor, for example, when it changes along a segment c - b - g, $V_N = V_S$ holds at the time $t_1$, and the signal $V_S$ is selected. This signal $V_S$ thereafter changes along pattern segments b - d - e.

That is, the slowdown command signal $V_S$ becomes:

$V_S = V_D + V_{BO}$ for a segment a - b, $V_S = V_D + V_B$ for a segment b - d, $V_S = V_D$ for a segment d - e. Here, $V_D = \sqrt{2\beta_A R_B}$ holds, $V_{BO}$ indicates the initial value of the bias value $V_B$and the bias value $V_B$ is the value which gradually decreases from the initial value $V_{BO}$ to the final value zero in time correspondence and which assumes $V_B = V_{BO}$ at the time $t_1$ and $V_B = 0$ at a time $t_2$ in FIG. 7.

Now, the calculation of the bias value $V_B$ for generating a signal as indicated by the segment b - d in FIG. 7, that is, the step 23 in FIG. 5 will be described with reference to FIG. 8 by means of which the terminal-floor slowdown command signal $V_S$ is corrected by adding a predetermined bias value to the slowdown command value $V_D$.

A step 230 is a decision step for proceeding to a step 231 when the flag CHG is "1", namely, $V_N \geqq V_S$ holds, and for proceeding to a step 232 when it is not "1".

At the step 231, the bias value $V_B$ is set to the preset constant value $V_{BO}$, and a counter I which counts a value N corresponding to a time interval $t_2 - t_1$ (FIG. 7) is initialized to zero.

The step 232 is a decision step which compares the value of the counter I with the preset constant value N and which is followed by a step 233 for $I < N$ and by a step 234 for $I \geqq N$.

Figure 2:
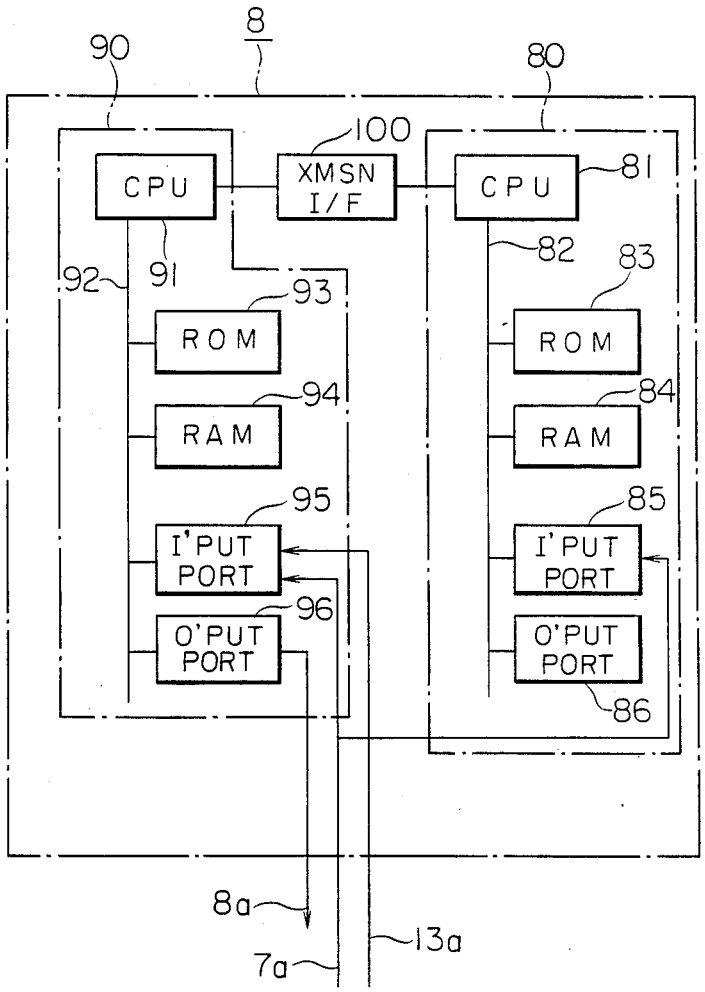
FIG. 2 is a block diagram of a microcomputer system in each of the apparatuses.
Figure 3:
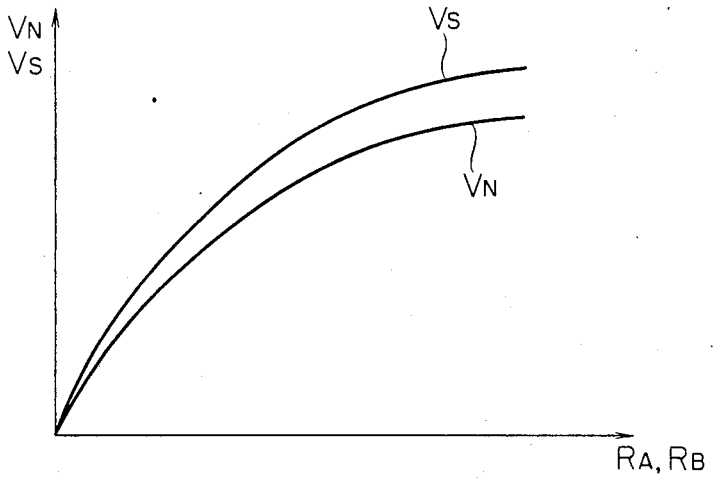
FIG. 3 PRIOR ART
FIGS. 3 and 4 are diagrams for explaining the operations of the prior-art elevator control apparatus.
Figure 4:
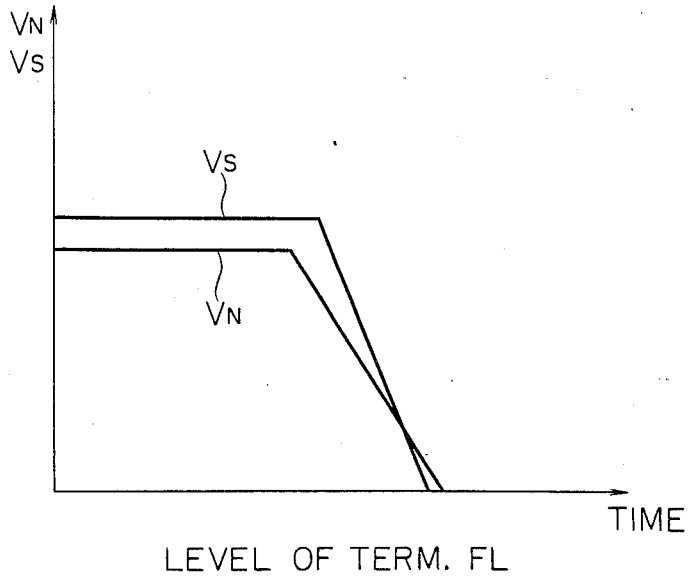
FIG. 4 PRIOR ART

At the step 233, the bias value $V_B$ is extracted from the table of the ROM 93 in FIG. 2 in correspondence with the value of the counter I, and the counter I is incremented by one. In the table, values $V_{BO} - \Delta V$, $V_{BO} - 2\Delta V$, . . . and $V_{BO}N\ \Delta V$ are stored in the order of addresses, and a relation of $V_{BO} = N\ \Delta V$ is held. $\Delta V$ is a unit decrement value for gradually decreasing the bias value $V_B$ in time correspondence.

At the step 234, the bias value $V_B$ is set to zero.

Figure 8:
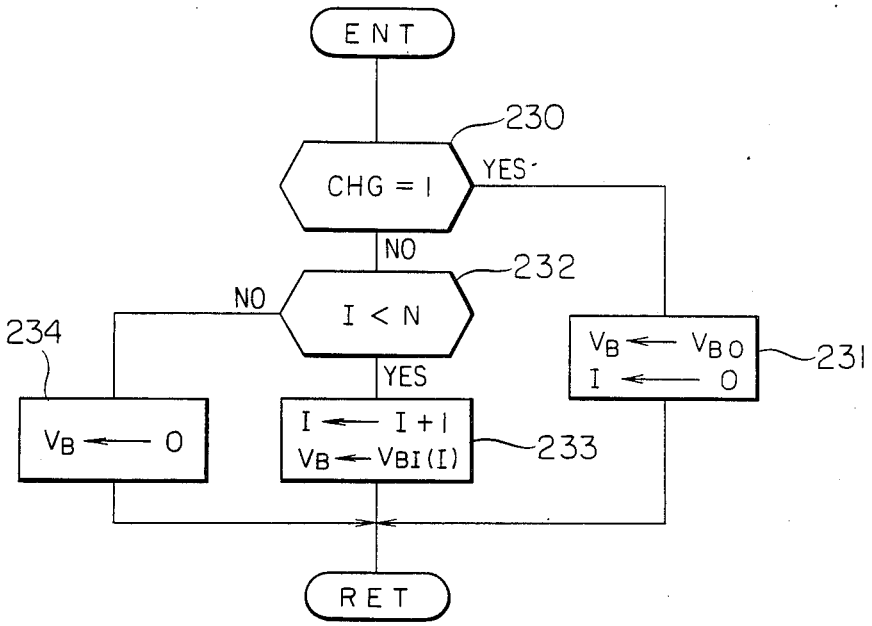
FIG. 8 is a flow chart showing in detail a bias value calculating step 23 in the flow chart of FIG. 5.

Thus, according to the flow chart of FIG. 8, when $V_N < V_S$ holds, the flag CHG is a value other than "1", and the bias value $V_B$ is $V_{BO}$. Accordingly, the calculated result of the terminal-floor slowdown command signal $V_S$ becomes the segment a - b - f in FIG. 7. On the other hand, when $V_N \geqq V_S$ holds, the flag CHG is set to "1". Therefore, the bias value $V_B$ decreases at the rate of $\Delta V$ per unit time during a fixed time interval (corresponding to the comparison reference value N for the counter I), and it becomes $V_B = 0$ upon lapse of the fixed time interval.

The initial value $V_{BO}$ of the bias value $V_B$ is determined as follows.

Letting $T_a$ denote the response delay time of the terminal position detector 13, $T_b$ a delay time until the microcomputer 90 receives the output 13*a* of the terminal position detector 13, and $T_c$ a delay time until the signal $V_N$ calculated by the microcomputer 80 is transmitted to the microcomputer 90, a residual distance error $\Delta R$ involved in the calculated residual distance becomes:

$$\Delta R = v(T_1 + T_2 + T_3)$$

Here, v denotes the speed (for example, rated speed) of the cage 1.

Accordingly, letting R denote a distance which is required for slowing down the cage from the full-speed running to the stop thereof, the initial value $V_{BO}$ of the bias value $V_B$ may be set as follows:

$V_{BO} = \sqrt{2\beta_A(R + \Delta R)} - \sqrt{2\beta_A R}$ However, the initial value $V_{BO}$ is made larger than a value obtained with the aforementioned equation so as to prevent the terminal-floor slowdown command value $V_S$from being erroneously selected for the normal operation of the terminal-floor slowdown running. Herein, an excessively large initial value $V_{BO}$ enlarges a floor arrival error developing when the terminal-floor running operation is performed with the terminal-floor slowdown command signal $V_S$. Therefore, the initial value $V_{BO}$ is set within a range within which the floor arrival error does not become very large.

The normal speed command signal $V_N$ and the slowdown command value $V_D$ mentioned above are calculated as $V_N = \sqrt{2\beta_A R_A}$ by the computer 80 and as $V_D = \sqrt{2\beta_A R_B}$ by the computer 90, respectively. Accordingly, $V_N = V_D$ will hold if the residual distances $R_A$ and $R_B$ have no difference and the calculating cycle of the microcomputer 80 is equal to that of the microcomputer 90.

While the foregoing embodiment has been described as to the case where the intitial value of the bias value $V_B$ is the constant value $V_{BO}$, a plurality of initial values may well be prepared so as to select any of them in accordance with the residual distance.

As described above, according to this invention, when a normal speed command signal correctly follows the desired normal pattern and decreases gradually as a cage approaches a terminal-floor, a comfortable ride in a cage and the floor arrival accuracy of the cage are provided. Where the normal speed command signal does not follow the desired normal pattern due to an abnormality, the cage can be caused to safely arrive at the terminal floor by the use of a terminal-floor slowdown command signal calculated to change the normal pattern and then follow the normal pattern for at least a final portion until the cage arrives at the terminalfloor, thus maintaining a comfortable ride and providing precision in the arrival at the terminal-floor.

What is claimed is:

1. An elevator control apparatus for controlling operation of a cage in an elevator system, said elevator control apparatus conpirising:

means for generating a normal speed command signal having a normal pattern providing gradually decreasing terminal speed as the cage approaches a level of a terminal floor;

means for generating a terminal-floor slowdown signal including means for calculating a slowdown command value on the basis of actual residual distance to the level of the terminal floor and means for determining a bias value, the slowdown command value and bias value being used in generating the terminal-floor slowdown command signal and providing a normal pattern generally similar to the normal pattern of the normal speed command signal and separated therefrom by a magnitude determined by the bias value;

means for comparing the normal speed command signal and the terminal-floor slowdown command signal;

means for choosing the normal speed command signal as a final terminal slowdown command signal for controlling terminal speed of the cage when, based on comparing the command signals, the normal speed command signal is less than the terminal-floor slowdown command signal, or the terminal-floor slowdown command signal as the final terminal slowdown command signal for controlling terminal speed of the cage when, based on comparing the command signals, the normal speed command signal is not less than the terminal-floor slowdown command signal; and means for correcting the terminal-floor slowdown command signal when chosen as the final terminal slowdown command signal by changing the bias value used in generating the final terminal-floor slowdown command signal;

whereby the final terminal slowdown command signal follows at least a final portion of the normal pattern of the normal speed command signal.

2. An elevator control apparatus according to claim 1, wherein said normal speed command signal generating means and said terminal-floor slowdown command signal generating means are included in independent computers performing respective calculations at predetermined calculating cycles for generating the corresponding command signals, and the bias value is set to a value greater than an error in the normal speed command signal attributed to a delay time by one of said computers in generating the normal speed command signal.

3. An elevator control apparatus according to claim 1, including a terminal position detector providing an output signal when the cage has approached to a predetermined actual residual distance from the level of the terminal floor and means responsive to the output signal of said terminal position detector for setting the actual residual distance and for determining the gradually decreasing actual residual distance as the cage moves closer to the level of the terminal floor wherein the bias value is set to a value greater than an error in the terminal-floor slowdown command signal attributed to an operation delay time of said terminal position detector and a delay time in the output signal of said terminal position detector being received by said actual residual distance determining means.

4. An elevator control apparatus according to claim 1 wherein when the terminal-floor slowdown command signal is chosen as the final terminal-floor slowdown command signal, the bias value is set according to a successively decreasing function with respect to time, and the slowdown command value is addd to successively decreasing bias values in generating the final terminal-floor slowdown command signal.

5. An elevator control apparatus according to claim 4 wherein said terminal-floor slowdown command signal generating means determines the successively decreasing bias values by successively subtracting a fixed decrement value from a preset initial bias value every unit time.

6. An elevator control apparatus according to claim 5 wherein said terminal-floor slowdown command signal generating means includes memory means for storing a large number of said successively decreasing bias values and means for successively reading out the stored bias values from said memory means in the order of magnitudes.

7. An elevator control apparatus for controlling operation of a cage in an elevator system, said elevator control apparatus comprising:

means for calculating a residual distance from the cage to a level of a terminal floor and for generating a normal speed command signal corresponding to the residual distance and having a normal pattern providing gradually decreasing terminal speed as the cage approaches the level of the terminal floor;

a terminal position detector providing an output signal when the cage has approached to a predetermined actual residual distance from the level of the terminal floor;

means responsive to the output signal of said terminal position detector for setting the actual residual distance and for determining the gradually decreasing actual residual distance as the cage moves closer to the level of the terminal floor;

means for generating a terminal-floor slowdown command signal including means for receiving the actual residual distance determinations from the residual distance determining means and for calculating a slowdown command value on the basis thereof, and means for determining a bias value, the slowdown command value and bias value being used in generating the terminal-floor slowdown command signal and providing a normal pattern generally similar to the normal pattern of the normal speed command signal and separated therefrom by a magnitude determined by the bias value;

means for comparing the normal speed command signal and the terminal-floor slowdown command signal;

means for choosing the normal speed command signal as a final terminal slowdown command signal for controlling terminal speed of the cage when, based on comparing the command signals, the normal speed command signal is less than the terminal-floor slowdown command signal, or the terminal-floor slowdown command signal as the final terminal slowdown command signal for controlling terminal speed of the cage when, based on comparing the command signals, the normal speed command signal is not less than the terminal-floor slowdown command signal; and means for correcting the terminal-floor slowdown command signal when chosen as the final terminal slowdown command signal by changing the bias value used in generating the terminal-floor slowdown command signal;

whereby the final terminal slowdown command signal follows at least a final portion of the normal pattern of the normal speed command signal.

* * * * *